US010723015B1

(12) United States Patent
Vallow

(10) Patent No.: US 10,723,015 B1
(45) Date of Patent: Jul. 28, 2020

(54) TIRE TOP TOOL TRAY APPARATUS

(71) Applicant: Timothy Vallow, Nesbit, MS (US)

(72) Inventor: Timothy Vallow, Nesbit, MS (US)

( * ) Notice: Subject to any disclaimer, the term of this patent is extended or adjusted under 35 U.S.C. 154(b) by 0 days.

(21) Appl. No.: 16/450,209

(22) Filed: Jun. 24, 2019

(51) Int. Cl.

| | |
|---|---|
| ***B25H 5/00*** | (2006.01) |
| ***B25H 3/06*** | (2006.01) |
| ***B25H 1/00*** | (2006.01) |
| ***B25H 1/04*** | (2006.01) |
| ***A47B 3/08*** | (2006.01) |

(52) U.S. Cl.
CPC ..... *B25H 5/00* (2013.01); *A47B 3/0815* (2013.01); *B25H 1/0007* (2013.01); *B25H 1/04* (2013.01); *B25H 3/06* (2013.01); *A47B 2003/0821* (2013.01); *A47B 2003/0827* (2013.01)

(58) Field of Classification Search
CPC ..... B25H 5/00; B25H 1/0007; B25H 1/04; B25H 3/06; A47B 2003/0821; A47B 2003/0827; A47B 3/0815
See application file for complete search history.

(56) References Cited

U.S. PATENT DOCUMENTS 185,778 A * 12/1876 Pond ..... D06F 1/02 248/439
267,928 A * 11/1882 Pinckney ..... 108/129
279,778 A * 6/1883 Long ..... A47B 3/0815 248/439
1,709,927 A * 4/1929 Whitney ..... A47B 3/0815 108/18
2,690,942 A * 10/1954 Marcus ..... A47B 23/001 108/18
2,692,174 A * 10/1954 Whitehead ..... A47C 7/68 108/157.11
2,797,973 A * 7/1957 Culpepper ..... A47C 7/68 108/157.11
2,823,087 A * 2/1958 Zimmer ..... A47B 3/0815 108/18
3,123,935 A 3/1964 Williams
3,491,706 A * 1/1970 Glass ..... A47B 3/0812 108/125
4,010,696 A 3/1977 Priesman
4,079,679 A * 3/1978 Bechtold ..... A47B 3/0815 108/132
4,309,009 A * 1/1982 Mitchell ..... B25H 3/06 211/72
4,341,304 A * 7/1982 Diller ..... B25H 3/06 108/44
4,811,875 A * 3/1989 DiSimone ..... B25H 5/00 108/137
4,909,406 A * 3/1990 Wu ..... A45C 7/00 220/528

(Continued)

*Primary Examiner* — Hanh V Tran

(57) ABSTRACT

A tire top tool tray apparatus for storing tools on top of a tire while working on a truck includes a tray body comprising a tray inside. A pair of pivot rods is coupled to the tray body and a pair of legs is coupled to the pair of pivot rods. The pair of legs comprises a left leg and a right leg each having a pair of support arms coupled to a left pivot rod and a right pivot rod, respectively. The pair of legs each has a cross bar extending between the pair of support arms. The pair of legs moves between a collapsed position and an alternate extended position. A plurality of springs is coupled to the pair of pivot rods and applies pressure on the pair of pivot rods to move the pair of legs towards the collapsed position.

11 Claims, 7 Drawing Sheets

(56) References Cited

U.S. PATENT DOCUMENTS 5,016,772 A * 5/1991 Wilk ..... B65D 21/086 220/495.01
5,160,026 A * 11/1992 Marsh ..... B25H 3/022 206/373
5,497,706 A * 3/1996 Yong ..... A47B 3/0815 108/129
5,738,425 A * 4/1998 Rosenberg ..... A47B 88/994 312/348.3
5,909,922 A * 6/1999 Dugas ..... A47C 7/70 108/43
5,937,766 A * 8/1999 Denny ..... B25H 5/00 108/143
6,038,984 A * 3/2000 Freitag ..... B25H 3/06 108/44
6,073,794 A * 6/2000 Bidot ..... A47B 88/994 220/529
6,082,270 A * 7/2000 Zerger ..... B60N 3/001 108/42
D481,282 S * 10/2003 Kitchen ..... D3/318
7,207,438 B2 4/2007 Lieffring
7,290,746 B1 * 11/2007 Macias ..... A47C 7/70 108/42
8,465,336 B2 * 6/2013 Byrd ..... B65D 21/086 446/69
8,608,262 B1 * 12/2013 Daros ..... A47B 88/941 312/205
8,807,355 B2 * 8/2014 Merey ..... A47B 97/00 211/175
9,421,684 B1 8/2016 Walcher
D776,826 S * 1/2017 Foley ..... E04G 1/34 D25/66
10,012,000 B2 * 7/2018 Yoo ..... E04G 1/28
2002/0059887 A1 * 5/2002 Marshall ..... B25H 5/00 108/39
2002/0096979 A1 * 7/2002 Johnson ..... A47B 45/00 312/205
2004/0004420 A1 * 1/2004 Pine ..... A47B 88/994 312/348.3
2004/0159578 A1 * 8/2004 Lieffring ..... B25H 3/06 206/557
2006/0169539 A1 * 8/2006 Grebinoski ..... E04G 1/15 182/223
2007/0159040 A1 * 7/2007 Fernandez ..... B25H 3/023 312/348.3
2009/0078165 A1 * 3/2009 Tseng ..... A47B 3/0912 108/6
2011/0272213 A1 * 11/2011 Taron ..... B25H 1/04 182/155
2017/0183881 A1 * 6/2017 Yoo ..... E04G 1/34
2018/0085912 A1 * 3/2018 Cindric ..... B25H 1/04
2018/0319007 A1 * 11/2018 Wilkinson ..... B66F 11/04

* cited by examiner

TIRE TOP TOOL TRAY APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tool trays and more particularly pertains to a new tool tray for storing tools on top of a tire while working on a truck.

BRIEF SUMMARY OF THE INVENTION

An embodiment of the disclosure meets the needs presented above by generally comprising a tray body comprising a front wall, a back wall, a left wall, a right wall, a bottom side, and an open top side defining a tray inside. A pair of pivot rods comprises a left pivot rod and a right pivot rod pivotably extending through the bottom side of the tray body from the front wall through the back wall adjacent the left wall and the right wall, respectively. A pair of legs is coupled to the pair of pivot rods. The pair of legs comprises a left leg and a right leg each having a pair of support arms coupled to the left pivot rod and the right pivot rod, respectively. Each of the left leg and the right leg has a cross bar extending between the pair of support arms. The pair of support rods is separated by a distance greater than a width of a tire of a truck. The pair of legs move between a collapsed position adjacent the bottom side of the tray body and an alternate extended position. A plurality of springs is coupled to the pair of pivot rods. The plurality of springs applies pressure on the pair of pivot rods to move the pair of legs towards the collapsed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
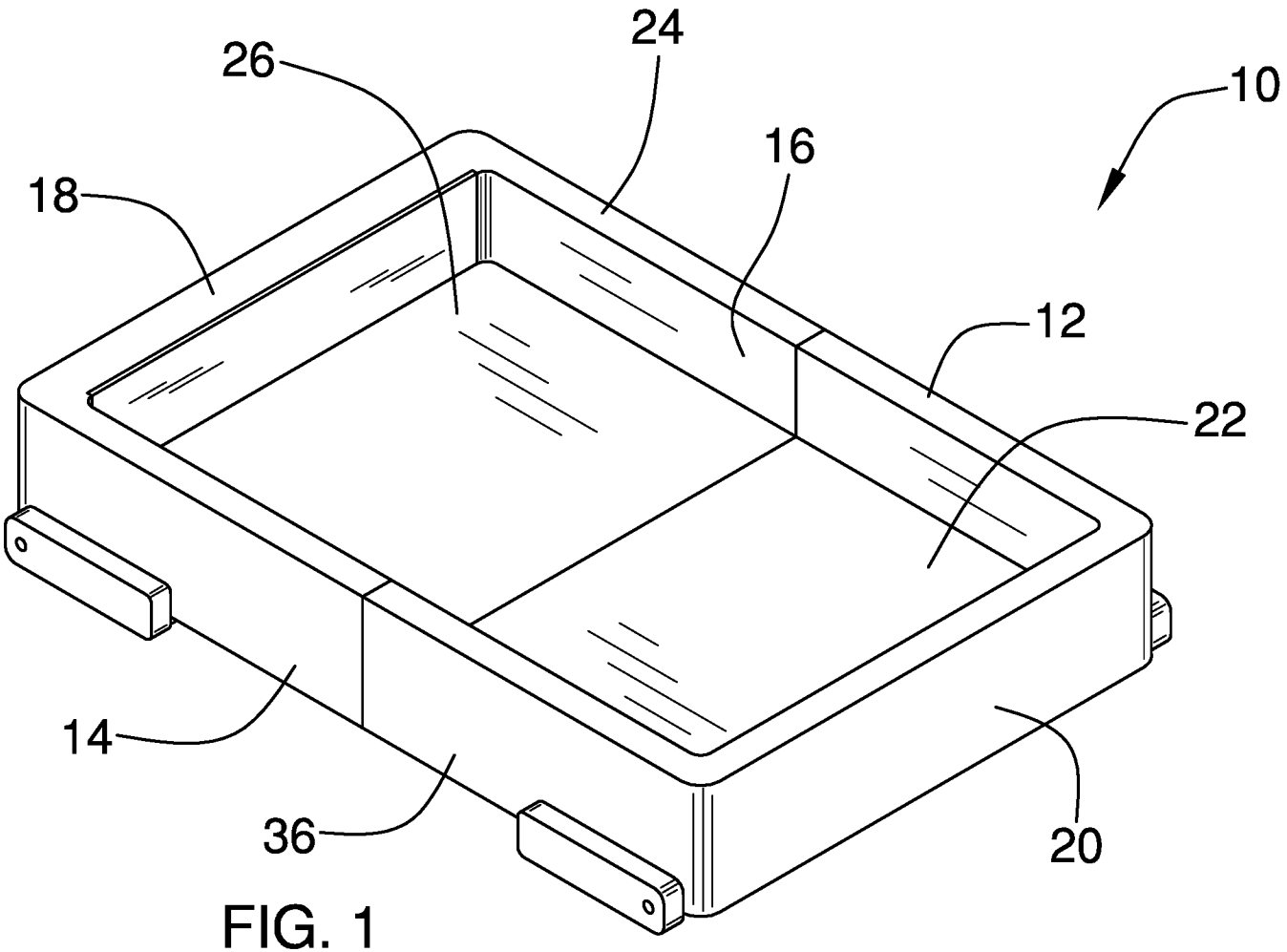
FIG. 1 is an isometric view of a tire top tool tray apparatus according to an embodiment of the disclosure.
Figure 2:
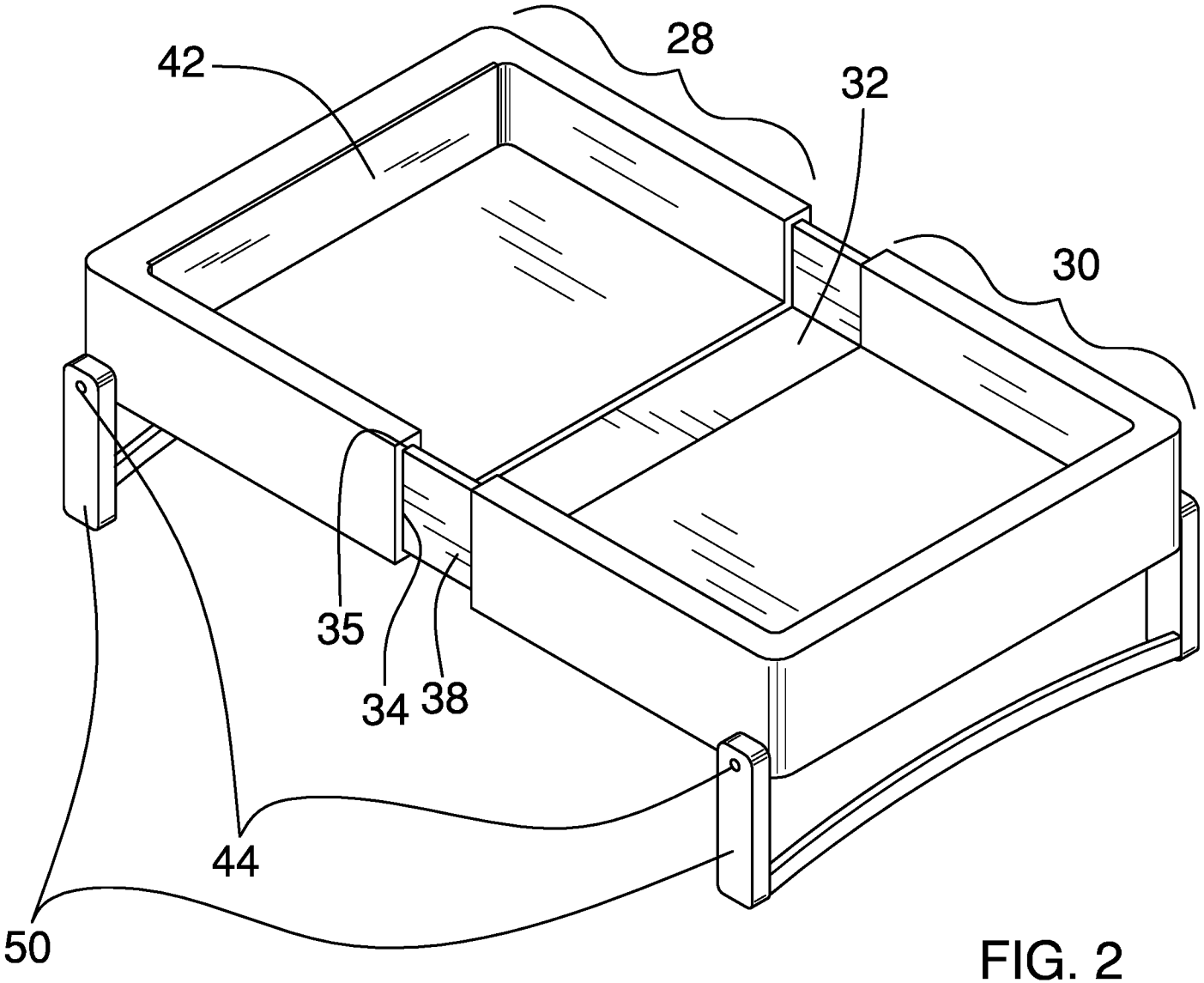
FIG. 2 is an isometric view of an embodiment of the disclosure.
Figure 3:
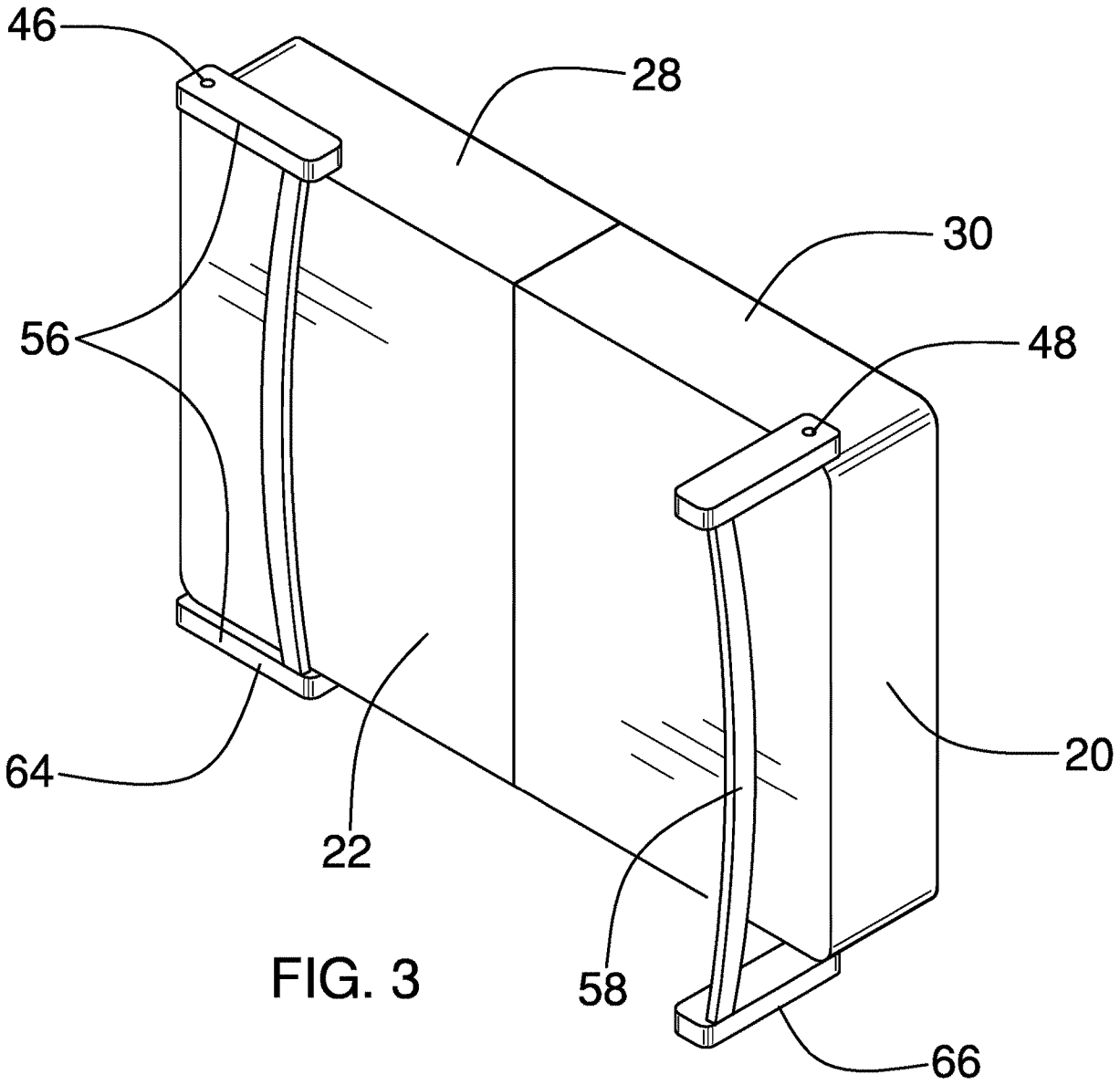
FIG. 3 is an isometric view of an embodiment of the disclosure.
Figure 4:
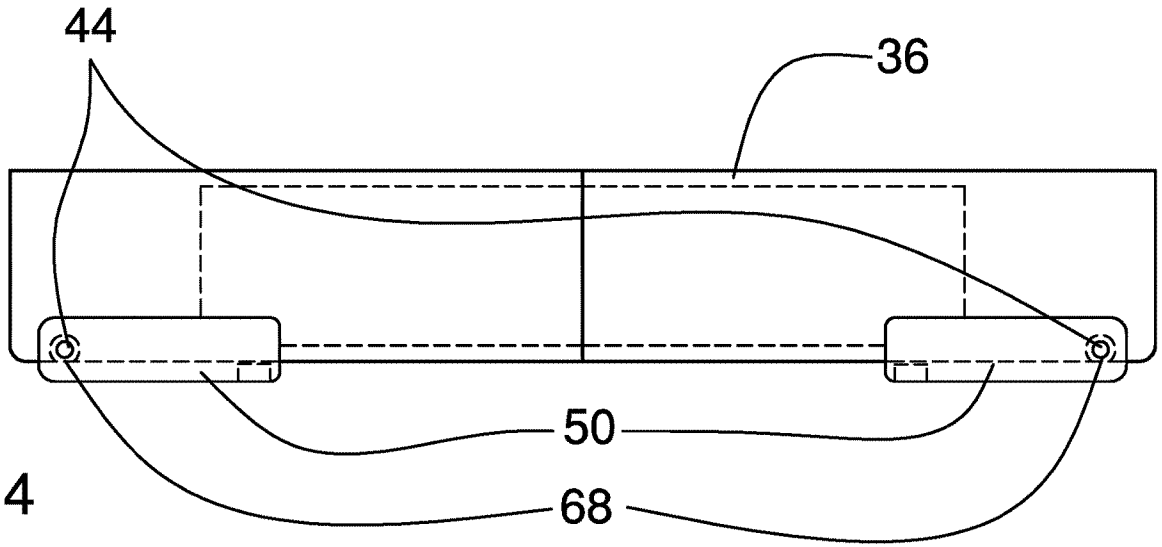
FIG. 4 is a front elevation view of an embodiment of the disclosure.
Figure 5:
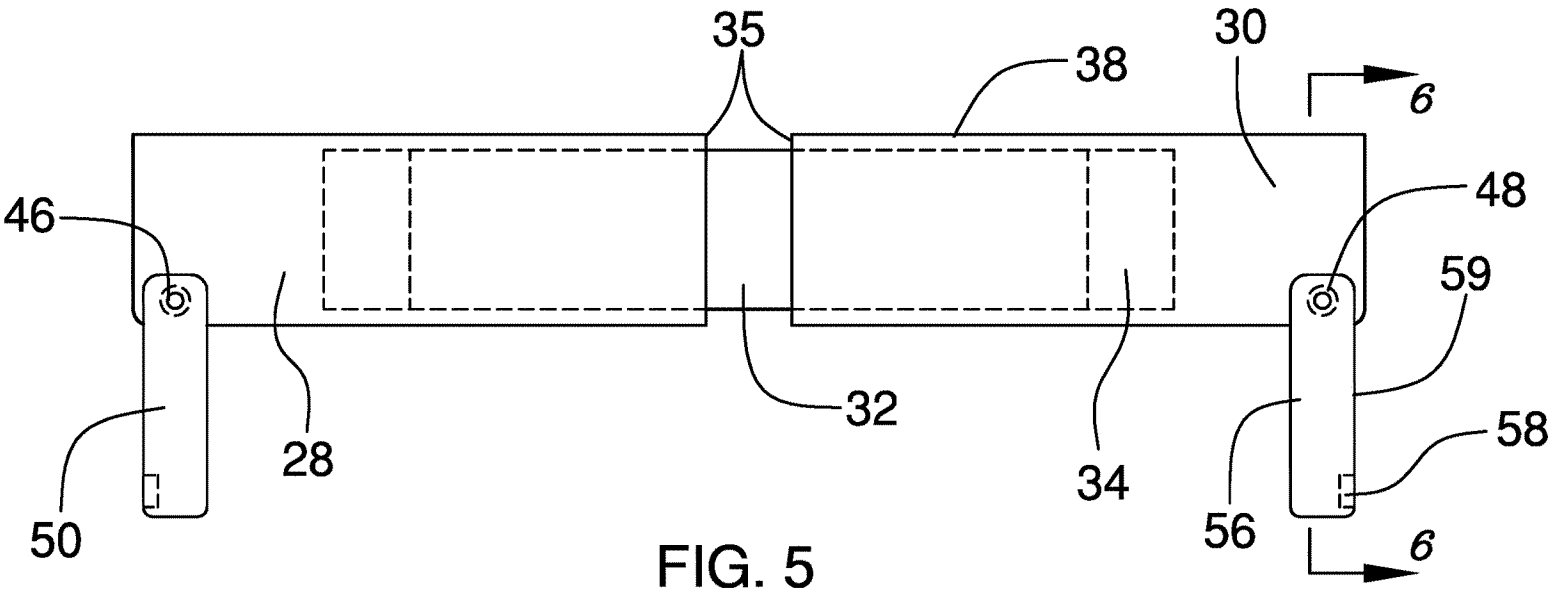
FIG. 5 is a rear elevation view of an embodiment of the disclosure.
Figure 6:
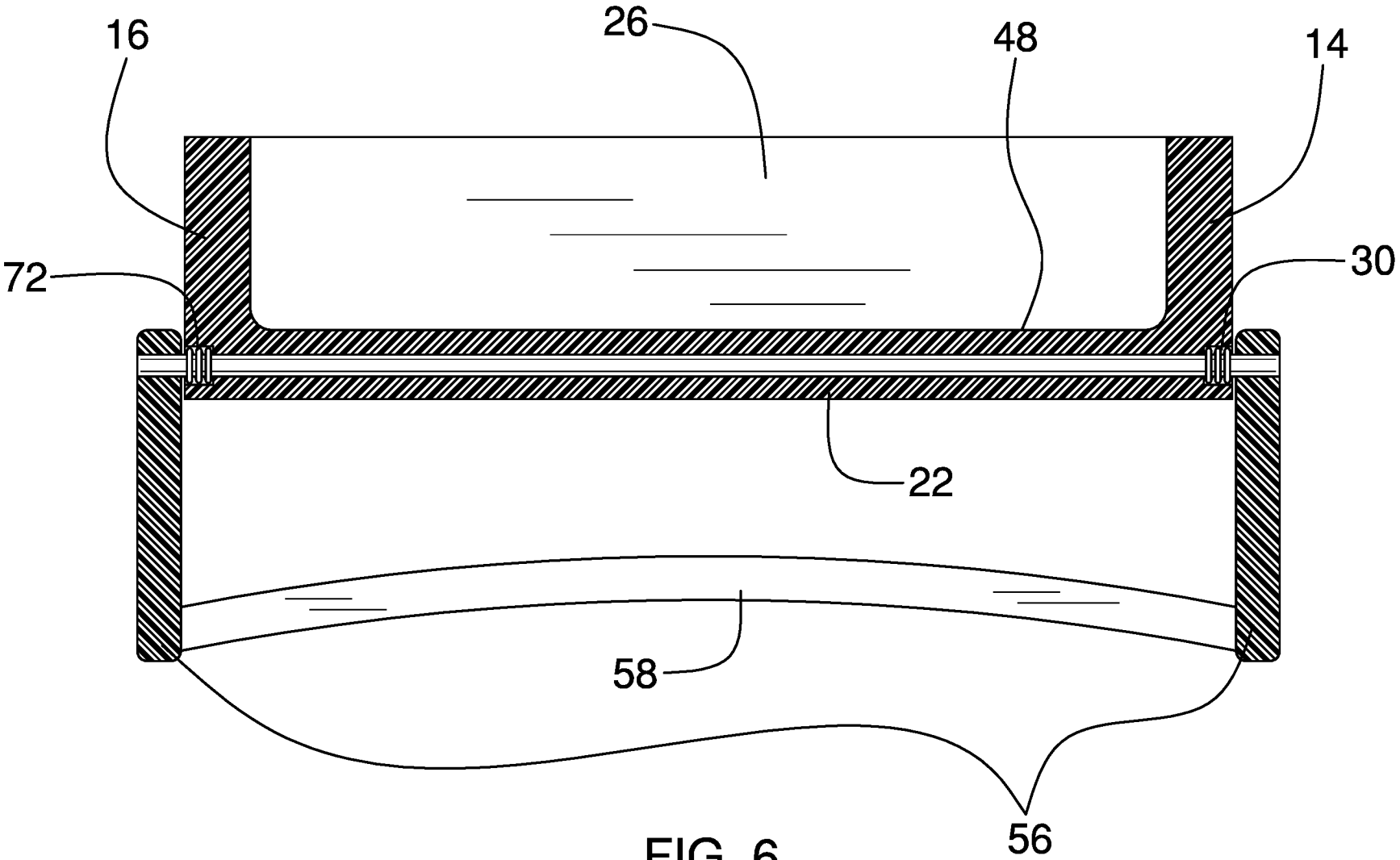
FIG. 6 is a cross section view along the line 6-6 of an embodiment of the disclosure.
Figure 7:
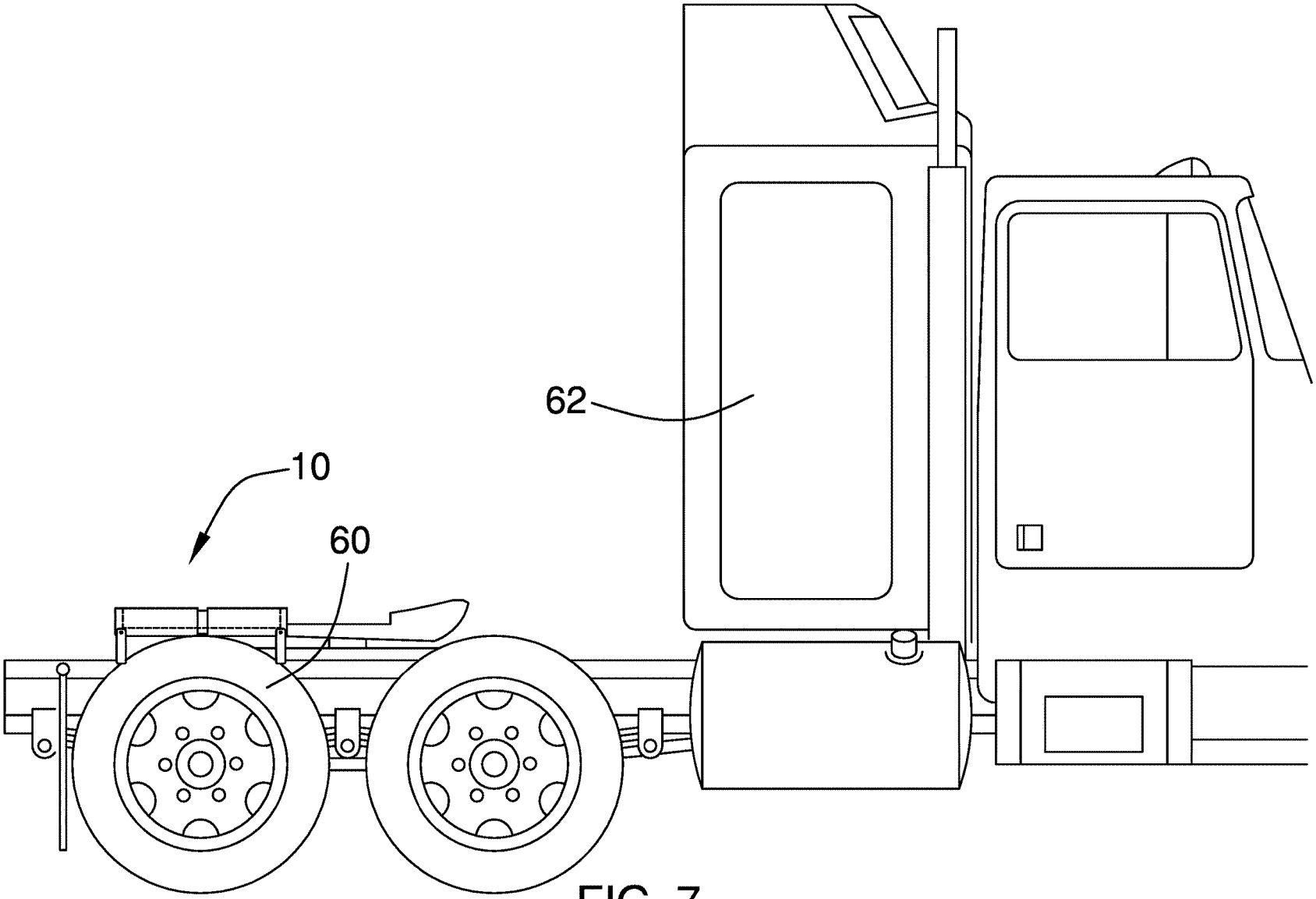
FIG. 7 is an in-use view of an embodiment of the disclosure.
Figure 8:
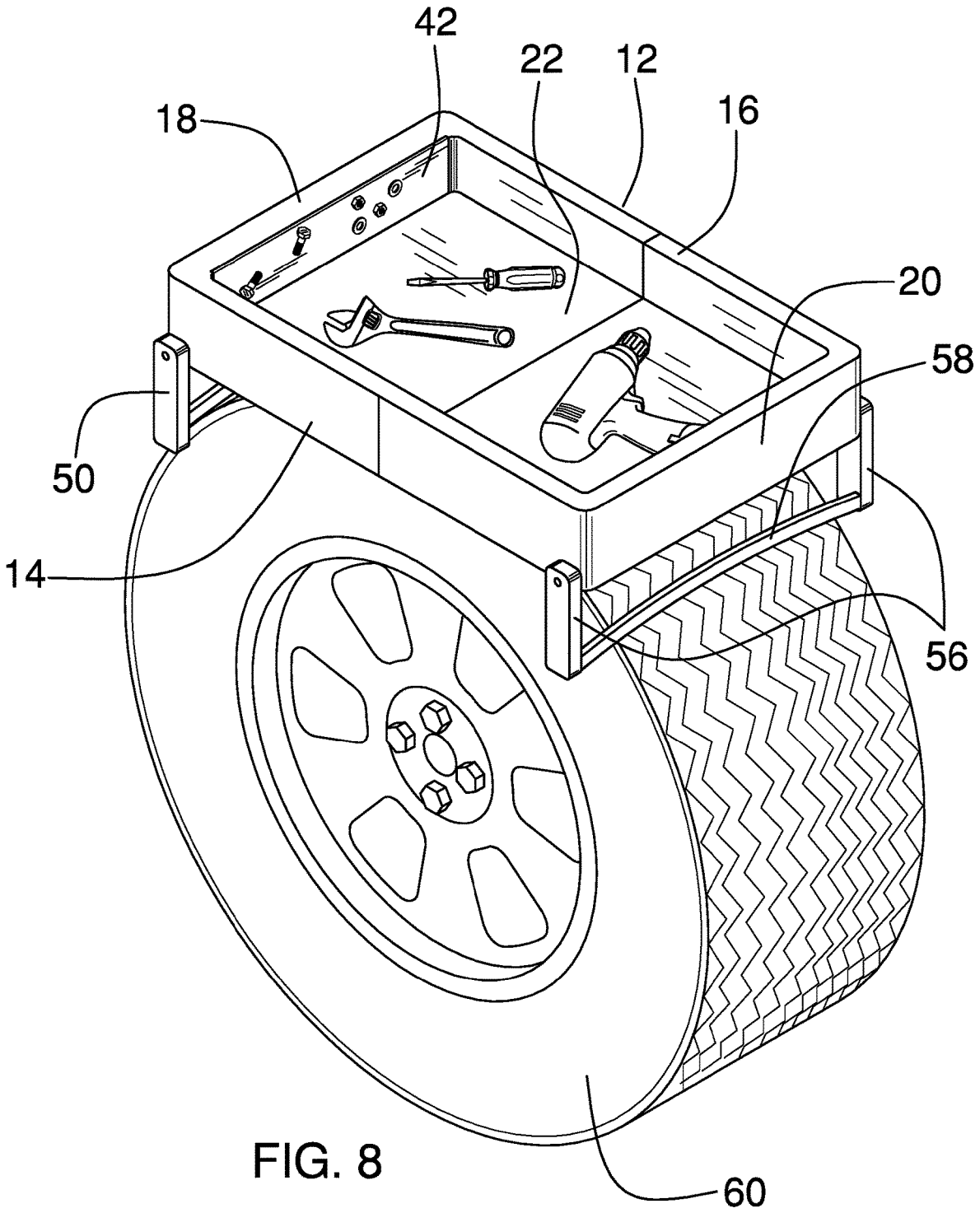
FIG. 8 is an in-use view of an embodiment of the disclosure.

With reference now to the drawings, and in particular to FIGS. 1 through 8 thereof, a new tool tray embodying the principles and concepts of an embodiment of the disclosure and generally designated by the reference numeral 10 will be described.

As best illustrated in FIGS. 1 through 8, the tire top tool tray apparatus 10 generally comprises a tray body 12 comprising a front wall 14, a back wall 16, a left wall 18, a right wall 20, a bottom side 22, and an open top side 24 defining a tray inside 26. The tray body 12 comprises a left half 28, a right half 30, and a tray extension 32. Each of the left half 28 and the right half 30 has an extension channel 34 extending through a medial surface 35 of the front wall 14, the bottom side 22, and the back wall 16. The tray extension 32 conforms to the extension channel 34 to allow the left half 28 and the right half 30 to slidably move between a closed position 36 hiding the tray extension 32 and an alternate open position 38 exposing the tray extension 32. The extension channel 34 and the tray extension 32 have a square U-shape profile. The tray extension 32 allows the tray body 12 to expand to fit additional tools and mount on larger tires. A magnetic strip 42 is coupled to the left wall 18 within the tray inside 26. The magnetic strip 42 secures nuts, bolts, and other small, ferrous hardware and fasteners. A pair of pivot rods 44 is coupled to the tray body 12. The pair of pivot rods 44 comprises a left pivot rod 46 and a right pivot rod 48 pivotably extending through the bottom side 22 of the tray body 12 from the front wall 14 through the back wall 16 adjacent the left wall 18 and the right wall 20, respectively. A pair of legs 50 is coupled to the pair of pivot rods 44 comprising a left leg 52 and a right leg 54 each having a pair of support arms 56 coupled to the left pivot rod 46 and the right pivot rod 48, respectively. Each of the left leg 52 and the right leg 54 has a cross bar 58 extending between the pair of support arms 56. The cross bar 58 is arched towards the respective pivot rod 44. The cross bar 58 of each of the pair of legs 50 is coupled adjacent an outer edge 59 of each of the pair of support arms 56. The pair of support rods 44 is separated by a distance greater than a width of a tire 60 of a truck 62. The cross bar 58 is arched to better conform to the shape of the tire 60. The pair of legs 50 moves between a collapsed position 64 adjacent the bottom side 22 of the tray body 12 and an alternate extended position 66. A width of the cross bar 58 may be less than 30% of a width of each support arm 56 to allow the pair of legs 50 to be fully horizontal in the collapsed position 64. A plurality of springs 68 comprises a pair of front springs 70 coupled to the pair of pivot rods 44 within the bottom side 22 adjacent the front wall 14 and a pair of back springs 72 coupled to the pair of pivot rods 44 within the bottom side 22 adjacent the back wall 16. The plurality of springs 68 applies pressure on the pair of pivot rods 44 to move the pair of legs 50 towards the collapsed position 64.

In use, the tray body 12 is moved from the closed position 36 to the alternate open position 38 to create the desired size of the tray inside 26. The pair of legs 50 is moved to the extended position 66 and the apparatus 10 is placed on the tire 60 such that the bottom side 22 of the tray body 12 rests on the tire 60 and the cross bar 58 of each of the pair of legs 50 applies additional support with the plurality of springs 68 squeezing the pair of legs 50 on the tire. Tools and hardware are placed within the tray inside 26 as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tire top tool tray apparatus comprising:

a tray body, the tray body comprising a front wall, a back wall, a left wall, a right wall, a bottom side, and an open top side defining a tray inside;

a pair of pivot rods coupled to the tray body, the pair of pivot rods comprising a left pivot rod and a right pivot rod pivotably extending through the bottom side of the tray body from the front wall through the back wall adjacent the left wall and the right wall, respectively;

a pair of legs coupled to the pair of pivot rods, the pair of legs comprising a left leg and a right leg each having a pair of support arms coupled to the left pivot rod and the right pivot rod, respectively, each of the left leg and the right leg having a cross bar extending between the pair of support arms, the pair of support arms being separated by a distance greater than a width of a tire of a truck, the pair of legs moving between a collapsed position adjacent the bottom side of the tray body and an alternate extended position; and a plurality of springs coupled to the pair of pivot rods, the plurality of springs applying pressure on the pair of pivot rods to move the pair of legs towards the collapsed position.

2. The tire top tool tray apparatus of claim 1 further comprising the cross bar of each pair of legs being arched towards the respective pivot rod of the pair of pivot rods.

3. The tire top tool tray apparatus of claim 1 further comprising the tray body comprising a left half, a right half, and a tray extension, each of the left half and the right half having an extension channel extending through a medial surface of the front wall, the bottom side, and the back wall, the tray extension conforming to the extension channel to allow the left half and the right half to slidably move between a closed position hiding the tray extension and an alternate open position exposing the tray extension.

4. The tire top tool tray apparatus of claim 3 further comprising the extension channel and the tray extension having a square U-shape profile.

5. The tire top tool tray apparatus of claim 1 further comprising a magnetic strip coupled to the tray body, the magnetic strip being coupled within the tray inside.

6. The tire top tool tray apparatus of claim 5 further comprising the magnetic strip being coupled to the left wall.

7. The tire top tool tray apparatus of claim 1 further comprising the plurality of springs comprising a pair of front springs coupled to the pair of pivot rods within the bottom side adjacent the front wall and a pair of back springs coupled to the pair of pivot rods within the bottom side adjacent the back wall.

8. The tire top tool tray apparatus of claim 1 further comprising each of the pair of support arms being rectangular prismatic.

9. The tire top tool tray apparatus of claim 1 further comprising the cross bar of each of the pair of legs being coupled adjacent an outer edge of each of the pair of support arms.

10. The tire top tool tray apparatus of claim 9 further comprising a width of the cross bar being less than 30% of a width of each support arm.

11. A tire top tool tray apparatus comprising:

a tray body, the tray body comprising a front wall, a back wall, a left wall, a right wall, a bottom side, and an open top side defining a tray inside, the tray body comprising a left half, a right half, and a tray extension, each of the left half and the right half having an extension channel extending through a medial surface of the front wall, the bottom side, and the back wall, the tray extension conforming to the extension channel to allow the left half and the right half to slidably move between a closed position hiding the tray extension and an alternate open position exposing the tray extension, the extension channel and the tray extension having a square U-shape profile;

a magnetic strip coupled to the tray body, the magnetic strip being coupled to the left wall within the tray inside;

a pair of pivot rods coupled to the tray body, the pair of pivot rods comprising a left pivot rod and a right pivot rod pivotably extending through the bottom side of the tray body from the front wall through the back wall adjacent the left wall and the right wall, respectively;

a pair of legs coupled to the pair of pivot rods, the pair of legs comprising a left leg and a right leg each having a pair of support arms coupled to the left pivot rod and the right pivot rod, respectively, each of the left leg and the right leg having a cross bar extending between the pair of support arms, the cross bar being arched towards the respective pivot rod, the cross bar of each of the pair of legs being coupled adjacent an outer edge of each of the pair of support arms, a width of the cross bar being less than 30% of a width of each support arm, the pair of support arms being separated by a distance greater than a width of a tire of a truck, the pair of legs moving between a collapsed position adjacent the bottom side of the tray body and an alternate extended position; and a plurality of springs coupled to the pair of pivot rods, the plurality of springs comprising a pair of front springs coupled to the pair of pivot rods within the bottom side adjacent the front wall and a pair of back springs coupled to the pair of pivot rods within the bottom side adjacent the back wall, the plurality of springs applying pressure on the pair of pivot rods to move the pair of legs towards the collapsed position.

* * * * *